US009776411B2

(12) United States Patent
Tsutsui et al.

(10) Patent No.: US 9,776,411 B2
(45) Date of Patent: Oct. 3, 2017

(54) INKJET RECORDING HEAD AND METHOD OF MANUFACTURING THE SAME

(71) Applicant: CANON KABUSHIKI KAISHA, Tokyo (JP)

(72) Inventors: Satoshi Tsutsui, Yokohama (JP); Yohei Hamade, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/829,381

(22) Filed: Aug. 18, 2015

(65) Prior Publication Data

US 2016/0052270 A1 Feb. 25, 2016

(30) Foreign Application Priority Data

Aug. 20, 2014 (JP) ..... 2014-167744

(51) Int. Cl.
*B41J 2/16* (2006.01)

(52) U.S. Cl.
CPC ..... *B41J 2/1603* (2013.01); *B41J 2/1606* (2013.01); *B41J 2/1629* (2013.01); *B41J 2/1631* (2013.01); *B41J 2/1639* (2013.01); *B41J 2/1645* (2013.01)

(58) Field of Classification Search
CPC ..... B41J 2/1603; B41J 2/1606; B41J 2/1629; B41J 2/1604
See application file for complete search history.

(56) References Cited

U.S. PATENT DOCUMENTS

2009/0066771 A1* 3/2009 Mihara ..... B41J 2/17513 347/102
2012/0119201 A1* 5/2012 Ueno ..... H01L 51/5048 257/40
2013/0057618 A1* 3/2013 Ishizuka ..... B41J 2/1603 347/54
2014/0354745 A1* 12/2014 Miyamoto ..... H01L 27/1292 347/102
2014/0375725 A1* 12/2014 Sameshima ..... B41J 2/1433 347/45

FOREIGN PATENT DOCUMENTS

JP 2001-171121 A 6/2001

* cited by examiner

*Primary Examiner* — Jason Uhlenhake
(74) *Attorney, Agent, or Firm* — Canon U.S.A., Inc., IP Division

(57) ABSTRACT

In an inkjet recording head comprising a substrate including an energy-generating element that generates energy for ejecting a liquid, an ejection port for ejecting the liquid, and a liquid flow passage communicating with the ejection port, a liquid-repellent layer is formed on a surface of a member for forming the ejection port, and a liquid-repellent region and a liquid-nonrepellent region are formed on the same surface of the liquid-repellent layer by irradiating a part of the liquid-repellent layer with light including a wavelength decomposing the liquid-repellent component in the liquid-repellent layer.

12 Claims, 6 Drawing Sheets

INKJET RECORDING HEAD AND METHOD OF MANUFACTURING THE SAME

BACKGROUND OF THE INVENTION

Field of the Invention

The present invention relates to an inkjet recording head for recording by ejecting a liquid, such as an ink, onto a recording medium and a method of manufacturing the head.

Description of the Related Art

For inkjet recording heads for recording by ejecting liquids, such as an ink, to recording media, various improvements in performance, such as an increase in image quality and an increase in speed, have been proposed. In order to perform satisfactory ejection by ejecting an ink with a high accuracy, liquid repellency treatment of the ejection port surface has been proposed. Japanese Patent Laid-Open No. 2001-171121 proposes a method for improving the printing quality by partially removing the liquid-repellent layer to provide a liquid-repellent region of a liquid-repellent layer and a liquid-nonrepellent region of an ejection port-forming member on the ejection port surface. If a liquid-repellent layer is disposed on the entire surface of an ejection port-forming member to give liquid repellency, ink mist will accumulate to form an ink droplet, for example, during continuous printing, and the droplet may be drawn into the ejection port to cause non-ejection. Japanese Patent Laid-Open No. 2001-171121 describes that a liquid-nonrepellent region (the region where the liquid-repellent layer is not formed) disposed on a part of the surface of the ejection port-forming member can prevent ink mist from gathering on the liquid-nonrepellent region and prevent an ink droplet from being drawn into the ejection port.

SUMMARY OF THE INVENTION

The present invention provides a method of manufacturing an inkjet recording head comprising a substrate including an energy-generating element that generates energy for ejecting a liquid, an ejection port for ejecting the liquid, and a liquid flow passage communicating with the ejection port. The method comprises a step of forming a liquid-repellent layer on the entire ejection port-forming surface of a member forming the ejection port; a step of partially reducing a liquid repellency of the liquid-repellent layer to form, on the same surface of the liquid-repellent layer, a liquid-repellent region having a contact angle of 80 degrees or more with pure water and a liquid-nonrepellent region having a contact angle with pure water that is less than the contact angle of the liquid-repellent region by 30 degrees or more.

The present invention also provides an inkjet recording head comprising a substrate including an energy-generating element that generates energy for ejecting a liquid, an ejection port for ejecting the liquid, and a liquid flow passage communicating with the ejection port, wherein the entire ejection port-forming surface of a member forming the ejection port includes a liquid-repellent layer; and the liquid-repellent layer includes, on the same surface, a liquid-repellent region having a contact angle of 80 degrees or more with pure water and a liquid-nonrepellent region having a contact angle with pure water that is less than the contact angle of the liquid-repellent region by 30 degrees or more.

Further features of the present invention will become apparent from the following description of exemplary embodiments with reference to the attached drawings.

DESCRIPTION OF THE EMBODIMENTS

Figure 1:
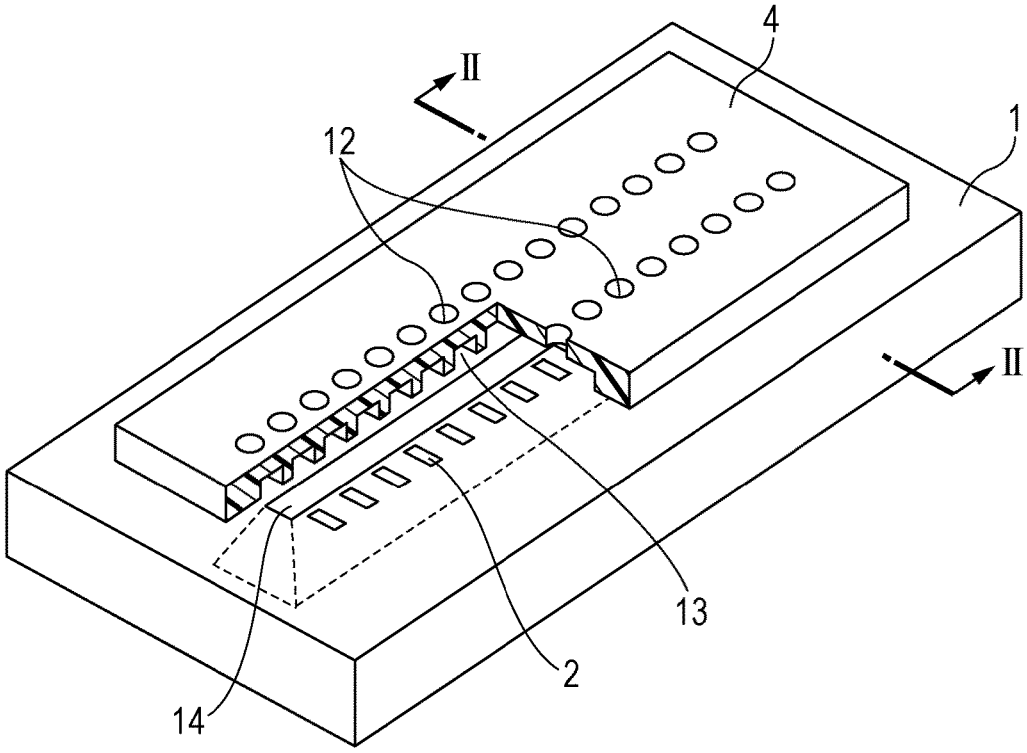
FIG. 1 is a schematic perspective view of an inkjet recording head.

In a case of continuously recording for a long time with a high frequency drive at a high printing speed and a high duty, a large amount of ink mist is generated. Accordingly, if an existing inkjet recording head including a liquid-nonrepellent region at which only the liquid-repellent layer is partially removed is used, a large amount of ink mist gathers in the liquid-nonrepellent region, which is a concave portion formed by the removal of the liquid-repellent layer. If an ink droplet becomes large enough not to be held by the liquid-nonrepellent region, the droplet may be drawn into the ejection port to cause non-ejection.

Ink droplets remaining on the surface can be periodically wiped off with, for example, a rubber blade, in order to maintain the status of the ejection port-forming surface of the ejection port-forming member in the inkjet recording head. However, when an existing inkjet recording head, as described in Japanese Patent Laid-Open No. 2001-171121, including a liquid-nonrepellent region at which only the liquid-repellent layer is partially removed is used, since the liquid-repellent layer is partially removed, the end of the liquid-repellent layer is inevitably exposed at the boundary between the liquid-repellent region and the liquid-nonrepellent region. When an ink adhering to the ejection port-forming surface of the ejection port-forming member is wiped off with a blade, the blade hits the end of the liquid-repellent layer, which may cause peeling off of the liquid-repellent layer starting from the abutting point.

Specifically, the present invention provides an inkjet recording head that can prevent ink droplets from being drawn into the ejection port, even in continuously recording for a long time with a high frequency drive at a high printing speed and a high duty, by holding occurring ink mist in the liquid-nonrepellent region and can prevent peeling off of the liquid-repellent layer even in wiping with a blade, and provides a method of manufacturing the inkjet recording head.

In an embodiment of the present invention, the liquid-nonrepellent region can be formed with a high positional accuracy, and the printing quality can be improved. In addition, the inkjet recording head of the present invention can have a plurality of liquid-repellent regions and a plurality of liquid-nonrepellent regions by forming a liquid-repellent layer on the entire ejection port-forming surface of the member forming an ejection port (hereinafter, referred to as ejection port-forming member) and partially reducing a liquid repellency of the liquid-repellent layer. In particular, in the method according to the embodiment of the present invention, the liquid repellency can be partially reduced by irradiating the liquid-repellent layer with light containing a wavelength decomposing the liquid-repellent component in the liquid-repellent layer. The term "liquid repellency" means that a liquid droplet, such as a water droplet or an ink droplet, being in contact with a member does not wet the membrane and not spread on the membrane. Whether a member has liquid repellency or not can be specified by measuring the contact angle (dynamic receding contact angle) of a liquid droplet on the surface of the member. A surface having a contact angle of at least 80 degrees with water is referred to as a liquid-repellent region. A surface having a contact angle less than the contact angle of the liquid-repellent region by 30 degrees or more is referred to as a liquid-nonrepellent region.

In the inkjet recording head, the ejection port can be effectively formed by, for example, processing by laser irradiation or processing by photolithography using a photosensitive resin. Processing by photolithography is highly useful, in particular, for arraying ejection ports at a high density. In the inkjet recording head according to the present invention, ejection ports arrayed at a high density can be readily formed simultaneous with formation of a liquid-repellent layer including liquid-nonrepellent regions by photolithography.

In the present invention, the ejection port-forming member is a member forming at least the ejection port-forming surface of the inkjet recording head and can also serve as a flow passage-forming member defining a liquid flow passage (hereinafter, referred to as flow passage) communicating with the ejection port, as shown in embodiments described below. The ejection port-forming member may be a member different from the flow passage-forming member, such as an orifice plate.

The inkjet recording head according to the present invention includes an energy-generating element, generating energy for ejecting a liquid, on a substrate. Examples of the energy-generating element include a mode of ejecting an ink by means of bubbles produced by causing film boiling in the ink with an electrothermal converter, a mode of ejecting an ink with an electromechanical converter, and a mode of ejecting an ink by utilizing static electricity. Any of various inkjet recording systems proposed in the technologies of inkjet liquid ejection can be used. Among them, from the viewpoint of performing printing at a high speed and a high density, the energy-generating element utilizing an electrothermal converter can be particularly used.

Embodiments according to the present invention will now be described with reference to the drawings, but the invention is not limited to these embodiments. In the descriptions below, the same configurations having the same functions in the drawings are designated with the same reference numerals, and descriptions thereof may be omitted.

FIG. 1 is a schematic perspective view illustrating an example of the inkjet recording head. The inkjet recording head shown in FIG. 1 includes a substrate 1 including a plurality of energy-generating elements 2. The substrate 1 includes an ejection port-forming member 4 forming flow passages 13 for retaining an ink and ejection ports 12 communicating with the respective flow passages 13 and ejecting the ink. The substrate 1 is further provided with a supply passage 14 passing through the substrate 1 and supplying an ink to the flow passages 13. Each step in an embodiment of the method of manufacturing an inkjet recording head of the present invention will be described using FIGS. 2A to 2H showing cross-sections taken along the line II-II in FIG. 1.

A positive photosensitive resin layer including a positive photosensitive resin becoming a mold material 3 for the flow passage is formed on the substrate 1 provided with energy-generating elements 2. Although any positive photosensitive resin can be used, in particular, a material showing a low absorbance for light that is used in exposure of a photocationic polymerizable resin layer 4P described below can be used for preventing a reduction in the patterning property due to sensitization during the exposure of the photocationic polymerizable resin layer 4P. For example, when the light is ultraviolet rays, such as i-rays, the positive photosensitive resin can be, for example, polymethyl isopropenyl ketone, which has sensitivity to Deep UV light. The positive photosensitive resin layer can be formed by, for example, dissolving a positive photosensitive resin in an appropriate solvent and applying the solution by spin coating and then performing prebaking. The thickness of the positive photosensitive resin layer corresponds to the height of the flow passage and is, therefore, appropriately determined in the designing of ejection of the inkjet recording head. The thickness can be, for example, 5 to 22 μm.

Figure 2A:
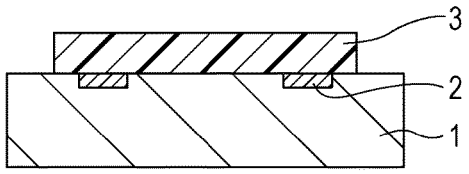
FIGS. 2A to 2H are process diagrams explaining an example of the method of manufacturing an inkjet recording head of the present invention.

Subsequently, the positive photosensitive resin layer is patterned into a mold material 3 (FIG. 2A). Patterning of the positive photosensitive resin layer is performed by, for example, pattern exposure by irradiating the positive photosensitive resin layer with activation energy rays that can sensitize the positive photosensitive resin through a mask. The positive photosensitive resin layer is then developed with, for example, a solvent that can dissolve the exposed portion, followed by rinsing treatment to form a mold material 3.

Figure 2B:
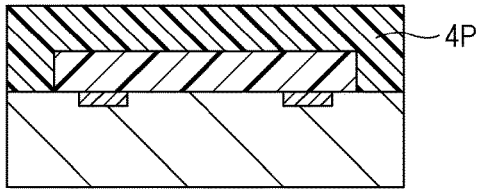

Subsequently, a photocationic polymerizable resin layer 4P including a photocationic polymerizable resin material and a photocationic polymerization initiator is formed on the mold material 3 and the substrate 1 (FIG. 2B). Examples of the photocationic polymerizable resin material include epoxy compounds, vinyl ether compounds, and oxetane compounds. Among these compounds, from the viewpoint of a high mechanical strength and a high adhesion to the base, the photocationic polymerizable resin material can be an epoxy compound. Examples of the epoxy compound include bisphenol A epoxy resins and novolac epoxy resins. Commercially available examples of the epoxy compound include "EHPE-3150" (trade name, manufactured by Daicel Corporation), "Celloxide 2021" (trade name, manufactured by Daicel Corporation), "GT-300 series" (trade name, manufactured by Daicel Corporation), "GT-400 series" (trade name, manufactured by Daicel Corporation), "157S70" (trade name, manufactured by Japan Epoxy Resin Co., Ltd.), "Epiclon N-865" (trade name, manufactured by DIC Corporation), and "SU8" (trade name, manufactured by Nippon Kayaku Co., Ltd.). These epoxy compounds have preferably an epoxy equivalent of 2000 or less and more preferably 1000 or less. An epoxy equivalent of 2000 or less can prevent a reduction in crosslink density in the curing reaction and can prevent reductions in glass transition temperature and adhesion of the cured material. The epoxy equivalent is a value measured in accordance with JIS K-7236.

Although the photocationic polymerization initiator may be an onium salt such as an ionic sulfonium salt or an iodonium salt, from the viewpoint of the degree of cationic polymerization activity, the photocationic polymerization initiator can be an onium salt having a phosphorus system $PF_6^-$ or an antimony system $SbF_6^-$ as an anion. Commercially available examples of such initiators include "SP-170" (trade name, manufactured by ADEKA Corporation) and "SP-172" (trade name, manufactured by ADEKA Corporation). The photocationic polymerizable resin layer 4P can be formed by, for example, dissolving a photocationic polymerizable resin material and a photocationic polymerization initiator in an appropriate solvent and applying the solution onto the mold material 3 and the substrate 1 by spin coating, followed by prebaking. In the case of using a solvent, a solvent not dissolving the mold material 3 is used. The photocationic polymerizable resin layer 4P may have any thickness. For example, the thickness from the upper surface of the mold material 3 can be 15 to 75 μm.

Figure 2C:
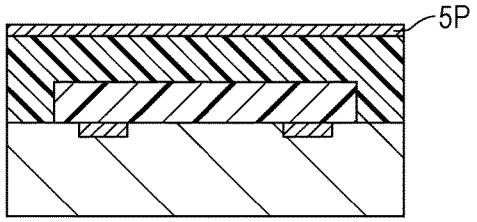

Subsequently, a liquid-repellent material layer 5P is formed on the uncured photocationic polymerizable resin layer 4P using a liquid-repellent material including a liquid-repellent component composed of a fluorine-containing compound (FIG. 2C). The liquid repellency of the fluorine-containing compound as a liquid-repellent component is not decreased in the first exposure step for forming ejection ports described below, but in the second exposure step, absorption of the irradiation wavelength to cause decomposition and thereby desorption of the fluorine-containing group, resulting in a decrease in liquid repellency. That is, in the second exposure step, a liquid-repellent region 10 and a liquid-nonrepellent region 11 are formed on the same surface of the liquid-repellent layer 5 described below. The fluorine-containing compound can be a compound including a carbonyl group having binding with a fluorine-containing group. In general, since a carbonyl group absorbs a wavelength of 300 nm or less, a liquid-nonrepellent region can be formed by, for example, performing the first exposure step at an i-ray wavelength of 365 nm and irradiating light of a wavelength of 300 nm or less in the second exposure step. Examples of the carbonyl group having binding with a fluorine-containing group in the present invention include those represented by Formula (1):

Formula (1)

$$F-Rf-A^1-\overset{\overset{\displaystyle O}{\|}}{C}-A^2-$$

where Rf represents a perfluoro alkyl group or a perfluoro polyether group; and $A^1$ and $A^2$ each independently represent a direct bond, an aliphatic group having 1 to 12 carbon atoms and optionally containing an oxygen and/or nitrogen atom, an aromatic group having 6 to 10 carbon atoms and optionally containing an oxygen atom, an alicyclic group, a urethane group (—O—C(=O)—NH—), or a —$CH_2CH(OT)CH_2$— group (where T is a hydrogen atom or an acetyl group $CH_3CO$—).

The fluorine-containing group can be a perfluoro alkyl group or a perfluoro polyether group, from the viewpoint of liquid repellency.

Specifically, examples of the perfluoro alkyl group include fluorine compounds containing groups represented by Formula (2), and examples of the perfluoro polyether group include fluorine compounds containing groups represented by Formula (3):

Formula (2)

$$-(CF_2)_k-$$

-continued

Formula (3)

$$-(CF_2CF_2CF_2O)_p-(CF_2CF_2O)_q-\left(\underset{\underset{\displaystyle CF_3}{|}}{CFCF_2O}\right)_r-(CF_2O)_s-$$

where k is an integer of 3 or more; and p, q, r, and s are each independently an integer of 0 or more, provided that at least one of p, q, r, and s is an integer of 1 or more.

In many of general commercially available such liquid-repellent materials, the integer represented by p, q, r, or s is larger than the integer represented by k in the numbers (k, p, q, r, and s) of the repeating units. Consequently, a liquid-repellent material molecule having a perfluoro polyether group contains a larger number of fluorine atoms than a liquid-repellent material molecule having a perfluoro alkyl group, and therefore has a higher liquid repellency to be advantageously used. A perfluoro polyether group moiety having a too small average molecular weight may not show liquid repellency, whereas a perfluoro polyether group moiety having a too large average molecular weight reduces the solubility in solvents. Accordingly, the average molecular weight of the perfluoro polyether group moiety of the liquid-repellent component in the liquid-repellent material can be 500 to 20000, such as 1000 to 10000.

Furthermore, the fluorine-containing compound is required to have, for example, a high mechanical strength and a low solubility to a solvent such as an ink. Accordingly, the fluorine-containing compound may have an inorganic reactive group. From the viewpoint of versatility, a compound having a hydrolyzable silane group on the terminal can also be used.

Specifically, examples of the fluorine-containing compound having a hydrolyzable silane group include fluorine-containing compounds represented by Formula (4):

Formula (4)

$$F-Rf-D-[Q-SiR_aY_{3-a}]_n$$

where Rf represents a perfluoro alkyl group or a perfluoro polyether group; R represents a hydrolyzable substituent group; Y represents a nonhydrolyzable substituent group; D represents an aliphatic group having 1 to 12 carbon atoms and containing an oxygen, including a carbonyl group, and a nitrogen atom; Q represents an organic group having 1 to 12 carbon atoms; n is an integer of 1 or more; and a is an integer of 1 to 3.

Examples of the hydrolyzable substituent group include halogen atoms, alkoxy groups, amino groups, and a hydrogen atom. Among them, in particular, alkoxy groups, such as a methoxy and an ethoxy group, having high versatility can be used. Examples of the nonhydrolyzable group include alkyl groups, such as a methyl and an ethyl group.

Examples of the hydrolyzable silane compound having a perfluoro polyether group include compounds represented by Formula (5):

Formula (5)

$$F-\left(\underset{\underset{\displaystyle CF_3}{|}}{CFCF_2O}\right)_t-\underset{\underset{\displaystyle CF_3}{|}}{CF}-\overset{\overset{\displaystyle O}{\|}}{C}-\underset{\underset{\displaystyle CH_2CH_2CH_2-Si(OCH_3)_3}{|}}{N}-CH_2CH_2CH_2-Si(OCH_3)_3$$

where t is an integer of 3 to 60.

The fluorine-containing compound having a hydrolyzable silane group can also be a condensate including a hydrolyzable silane compound having a perfluoro alkyl group or perfluoro polyether group and a hydrolyzable silane compound having a cationic polymerizable group, from the viewpoint of the reactivity to the photocationic polymerizable resin layer becoming an ejection port-forming member, mechanical strength, and ink durability. The presence of the hydrolyzable silane compound having a cationic polymerizable group forms an ether bond between a fluorine-containing compound and a photocationic polymerizable resin layer by a reaction with the functional group (cationic polymerizable group, such as an epoxy group, a vinyl ether group, or an oxetanyl group) of the cationic polymerizable resin, in the presence of a cationic polymerization initiator. As a result, the mechanical strength and the ink durability are improved.

In addition to the hydrolyzable silane compound, a condensate including an alkyl substituted hydrolyzable silane compound can also be used. The presence of the alkyl substituted hydrolyzable silane compound improves the degree of freedom of the condensate. As a result, orientation of the hydrolyzable silane compound having a perfluoro alkyl group or a perfluoro polyether group to the air interface side is facilitated. In addition, the presence of, for example, an alkyl group prevents cleavage of a siloxane bond to improve the liquid repellency and ink durability.

In order to improve the coating ability, a polymer including a monomer unit having a carbonyl group having a bond with a fluorine-containing group can also be used, where the fluorine-containing group is represented by Formula (6):

Formula (6)

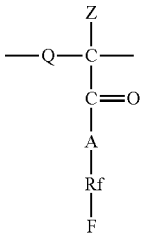

where Rf represents a perfluoro alkyl group or a perfluoro polyether group; A represents a direct bond, a linear, branched, or cyclic aliphatic group having 1 to 12 carbon atoms and optionally containing an oxygen and/or nitrogen atom, an aromatic group having 6 to 10 carbon atoms and optionally containing an oxygen atom, a urethane group (—O—C(═O)—NH—), or a —$CH_2CH(OT)CH_2$— group (where T is a hydrogen atom or an acetyl group $CH_3CO$—); Q represents an organic group having 1 to 12 carbon atoms; and Z represents a hydrogen atom or a methyl group.

From the viewpoint of a high mechanical strength and a low solubility to a solvent such as an ink, the polymer including a monomer unit represented by Formula (6) can also be used as a copolymer with a monomer unit represented by Formula (7) and a monomer unit represented by Formula (8). In particular, a block copolymer containing a block unit of each monomer unit can be used.

Formula (7)

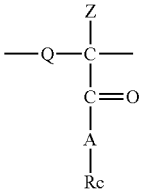

where Rc represents a cationic polymerizable group; A represents a direct bond, a linear, branched, or cyclic aliphatic group having 1 to 12 carbon atoms and optionally containing an oxygen and/or nitrogen atom, an aromatic group having 6 to 10 carbon atoms and optionally containing an oxygen atom, a urethane group (—O—C(═O)—NH—), or a —$CH_2CH(OT)CH_2$— group (where T is a hydrogen atom or an acetyl group $CH_3CO$—); Q represents an organic group having 1 to 12 carbon atoms; and Z represents a hydrogen atom or a methyl group.

Formula (8)

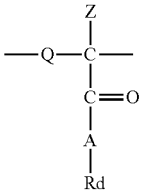

where Rd represents an alkyl group, an aryl group, or a reactive silane group; A represents a direct bond, a linear, branched, or cyclic aliphatic group having 1 to 12 carbon atoms and optionally containing an oxygen and/or nitrogen atom, an aromatic group having 6 to 10 carbon atoms and optionally containing an oxygen atom, a urethane group (—O—C(═O)—NH—), or a —$CH_2CH(OT)CH_2$— group (where T is a hydrogen atom or an acetyl group $CH_3CO$—); Q represents an organic group having 1 to 12 carbon atoms; and Z represents a hydrogen atom or a methyl group.

In the monomer units represented by Formulae (6) to (8), in particular, Q can represent an organic group having one carbon atom, methylene; and A can represent a (meth) acrylate unit having an oxygen atom on the carbonyl group side. Examples of the cationic polymerizable group represented by Rc in Formula (7) include functional groups as those mentioned for the cationic polymerizable resins, such as epoxy groups, vinyl ether groups, and oxetanyl groups.

The liquid-repellent material layer 5P can be formed by, for example, preparing a solution by dissolving the fluorine-containing compound in an appropriate solvent, and applying the solution by, for example, spin coating, slit coating, roll coating, dip coating, or vacuum deposition. The liquid-repellent material layer 5P has a thickness of preferably 50 to 10000 nm, more preferably 80 to 5000 nm, for providing sufficient liquid repellency and durability to the resulting liquid-repellent layer 5. A thickness of 50 nm or more can provide uniform liquid repellency and sufficient durability, and a thickness of 10000 nm or less can prevent a reduction in patterning characteristics, such as deformation of the pattern and a reduction in resolution.

Figure 2D:
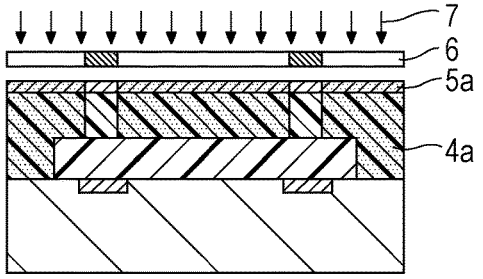

Subsequently, a first exposure step is performed (FIG. 2D). In the first exposure step, the cured regions of the photocationic polymerizable resin layer 4P and the liquid-repellent material layer 5P are irradiated with first exposure light 7 from above the liquid-repellent material layer 5P using a first mask 6. The first exposure light 7 may have a wavelength for generating an acid from the photocationic polymerization initiator. For example, i-rays can be used. In this embodiment, in the exposure region of the first exposure light 7, the acid generated from the photocationic polymerization initiator present in the photocationic polymerizable resin layer 4P diffuses into the liquid-repellent material layer 5P. As a result, if the liquid-repellent material layer 5P has a cationic polymerizable group, an ether bond is generated by a reaction of the cationic polymerizable group in the photocationic polymerizable resin layer 4P and the liquid-repellent material layer 5P, resulting in improvement of the mechanical strength and the ink durability. If the liquid-repellent material layer 5P contains a hydrolyzable silane compound, hydrolysis accompanied by moisture in the air occurs to generate a silanol group in the liquid-repellent material layer 5P. Furthermore, the presence of the above-mentioned acid promotes the dehydration condensation reaction to generate a siloxane bond and to improve the mechanical strength. The reaction of the silanol group with the cationic polymerizable group or the hydroxyl group of the photocationic polymerizable resin layer improves the mechanical strength and the ink durability. These actions allow simultaneous curing of the photocationic polymerizable resin layer 4P and the liquid-repellent material layer 5P in the exposure regions (4*a* and 5*a*) of the first exposure light 7 to secure the adhesion.

Figure 2E:
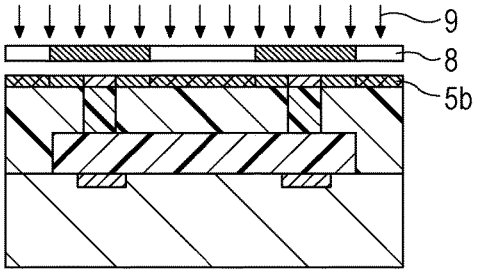

Subsequently, a second exposure step is performed (FIG. 2E). In the second exposure step, the unexposed portion of the liquid-repellent material layer 5P in the first exposure step and the region 5*b* except the portion becoming a liquid-repellent region 10 are exposed using a second mask 8 so as to form a desired liquid-nonrepellent region 11. On this occasion, second exposure light 9 having a wavelength decomposing the fluorine-containing compound and being different from that in the first exposure step, for example, 300 nm or less, is irradiated. The second exposure light 9 decomposes the fluorine-containing compound and reduces the liquid repellency to form a liquid-nonrepellent region 11. The liquid repellency of the liquid-nonrepellent region 11 of the present invention is reduced by decomposing the fluorine-containing compound and desorbing only the fluorine-containing group. Consequently, also in the development step described below, the fluorine-containing compound itself is cured in the first exposure step and is therefore not removed, and the end of the liquid-repellent region 10 is not exposed. The mask 8 has a pattern such that a liquid-repellent region 10 is formed at least in the periphery of the ejection port. The area for forming the liquid-nonrepellent region 11 is appropriately determined in the designing of ejection of the inkjet recording head.

Figure 2F:
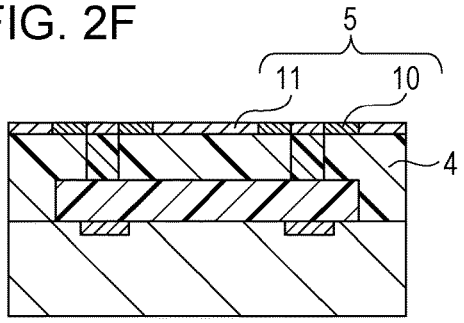

Subsequently, heat treatment is performed for facilitating simultaneous curing of the photocationic polymerizable resin layer 4P and the liquid-repellent material layer 5P (FIG. 2F). The heat treatment facilitates the reaction in the exposure regions 4*a* and 5*a* in the first exposure step and can provide durability to the subsequent development step. The heat treatment can be performed with, for example, a hot plate. The heat treatment may be performed at any temperature, for example, at 70° C. to 100° C. The heat treatment may be performed for any period of time, for example, for 3 to 5 minutes.

Figure 2G:
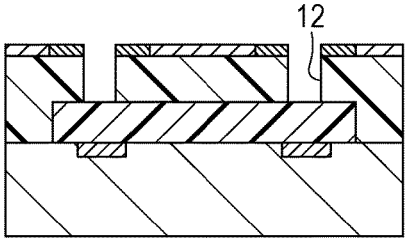

Subsequently, the unexposed portions of the photocationic polymerizable resin layer 4P and the liquid-repellent material layer 5P in the first exposure step are removed by development to form ejection ports 12 (FIG. 2G). On this occasion, the decomposed matter in the second exposure step is also removed. The developer used in the development may be any solution that can develop the photocationic polymerizable resin layer 4P of the unexposed portion. Examples of the developer include solution mixtures of methyl isobutyl ketone (MIBK) and xylene.

Figure 2H:
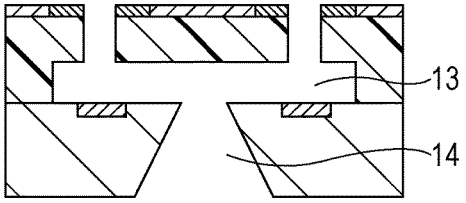

Subsequently, a supply passage 14 is formed in the substrate 1. The mold material 3 is then removed to form a flow passage 13 (FIG. 2H). When the substrate 1 is a silicon substrate, the supply passage 14 can be formed by, for example, anisotropic etching with an alkaline solution. The flow passage 13 can be formed by, for example, immersing the substrate 1 in a solvent that can dissolve the mold material 3 and removing the mold material 3. In addition, as necessary, the solubility of the mold material 3 may be enhanced by exposure to activation energy rays that can sensitize the mold material 3. In such a case, the exposure is performed at a wavelength that does not decompose the fluorine-containing compound in the liquid-repellent layer 5. Subsequently, electrical bonding for driving the energy-generating element 2 is performed. Ink supply and other members for supplying an ink are connected to manufacture an inkjet recording head.

Figure 3E:
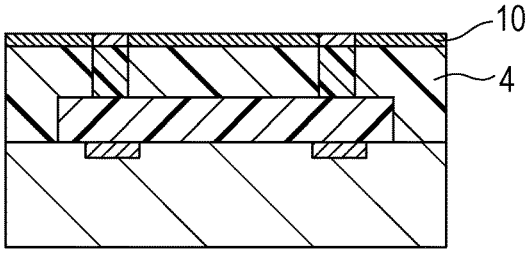
FIGS. 3E to 3H are process diagrams explaining another example of the method of manufacturing an inkjet recording head of the present invention.
Figure 3F:
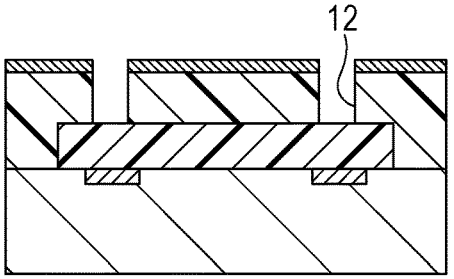
Figure 3G:
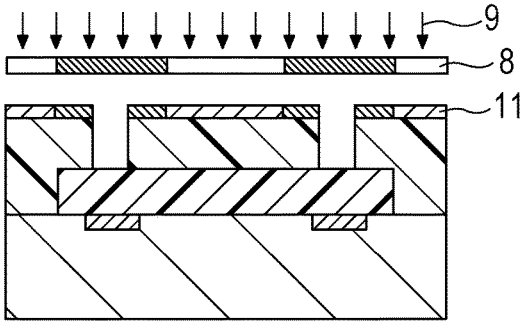
Figure 3H:
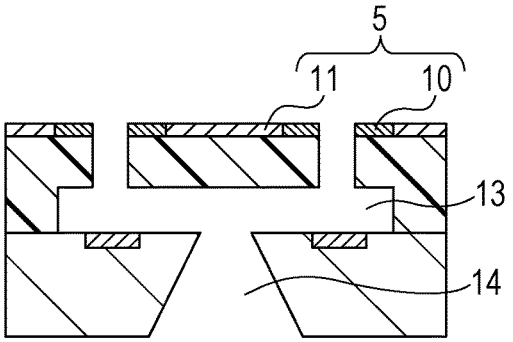

In another embodiment of the present invention, the steps up to the step shown in FIG. 2D are implemented, and heat treatment is then performed for facilitating simultaneous curing of the exposure regions 4*a* and 5*a* (FIG. 3E). Subsequently, as shown in FIG. 3F, the unexposed portions of the photocationic polymerizable resin layer 4P and the liquid-repellent material layer 5P in the first exposure step are removed by development to form an ejection port 12. The second exposure step (FIG. 3G) is then implemented, and as in the step shown in FIG. 2H, formation of a supply passage 14 and a liquid flow path by removal of the mold material 3 may be implemented (FIG. 3H).

Figure 4A:
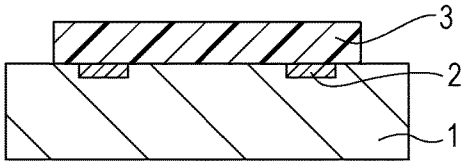
FIGS. 4A to 4I are process diagrams explaining another example of the method of manufacturing an inkjet recording head of the present invention.
Figure 4B:
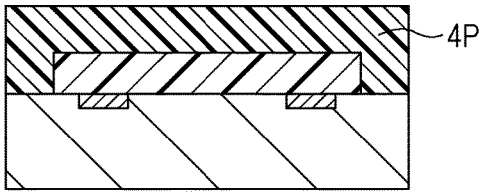
Figure 4C:
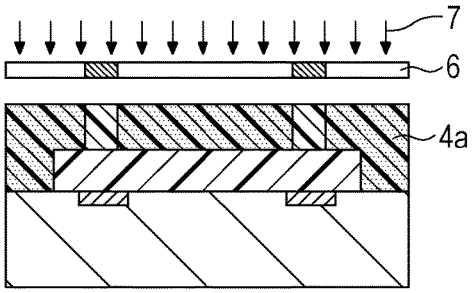
Figure 4D:
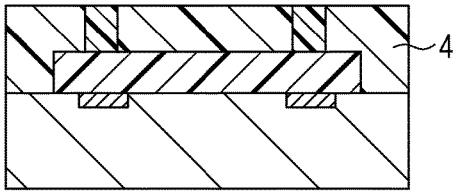
Figure 4E:
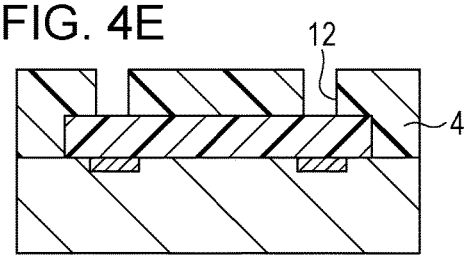
Figure 4F:
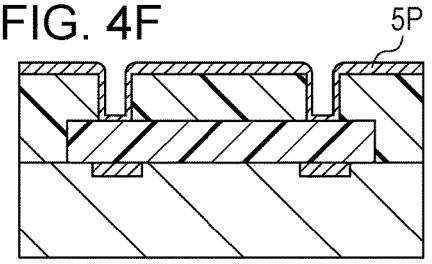
Figure 4G:
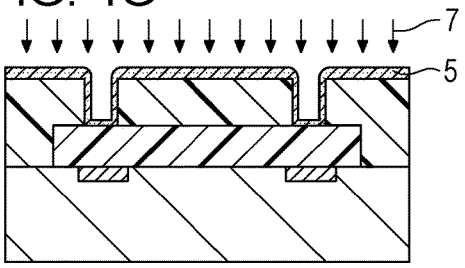
Figure 4H:
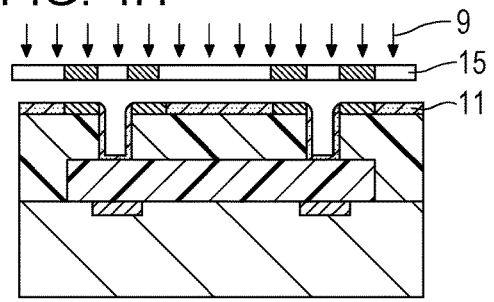
Figure 4I:
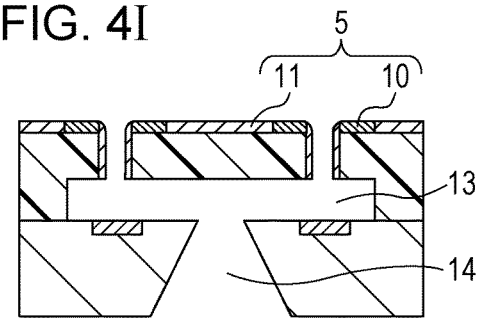

FIGS. 4A to 4I are diagrams illustrating another embodiment of the method of the present invention. FIGS. 4A and 4B are the same as FIGS. 2A and 2B, and descriptions thereof are omitted. Subsequently, the first exposure step is performed. That is, the photocationic polymerizable resin layer 4P formed on the substrate is irradiated with first exposure light 7 using a first mask 6 to form an exposure region 4*a* in the region except the region for forming ejection ports (FIG. 4C). Subsequently, the exposure region 4*a* is cured by heat treatment to form an ejection port-forming member 4 (FIG. 4D). The unexposed portion not subjected to exposure curing is removed by development to form ejection ports 12 (FIG. 4E). A liquid-repellent material layer 5P is then formed (FIG. 4F), and the entire surface is subjected to heat treatment by irradiation with first exposure light 7 to form a liquid-repellent layer 5 (FIG. 4G). Subsequently, the second exposure step, i.e., irradiation with second exposure light 9 using a third mask 15, is performed (FIG. 4H). On this occasion, the third mask 15 has a mask pattern allowing exposure of the insides of the ejection ports 12 in addition to the liquid-nonrepellent region 11. As a result, the fluorine-containing compound invaded into the ejection ports 12 are decomposed, resulting in a reduction in liquid repellency. Subsequently, as shown in FIG. 2H, a supply passage 14 is formed in the substrate 1, and a flow passage 13 is formed by removing the mold material 3 (FIG. 4I). In the removal of the mold material 3, the fluorine-containing compound decomposed on the mold material 3 is also removed to communicate the ejection port 12 with the flow passage 13. The formation of the liquid-repellent material layer 5P can be formed such that the amount of the fluorine-containing compound invading the insides of the ejection ports 12 is as less as possible, for example, by employing slit coating. If the amount of the fluorine-containing compound invading the insides of the ejection ports 12 is large, the first exposure step using the first mask 6 is implemented again in the step shown in FIG. 4G to leave the unexposed liquid-repellent material layer 5P in the ejection ports 12, and the unexposed portion may be removed by development. Alternatively, the step shown in FIG. 4G may be achieved by converting the liquid-repellent material layer 5P into a liquid-repellent layer 5 by heat treatment alone, without performing irradiation with the first exposure light 7. Since the step shown in FIG. 4C is performed before formation of the liquid-repellent layer 5, the first exposure light 7 used in the step may be UV light of 300 nm or less, which extends the range of selection of materials.

EXAMPLES

Examples of the present invention will now be described, but the present invention is not limited to the following Examples.

Example 1

An inkjet recording head was manufactured by the process shown in FIGS. 2A to 2H. Polymethyl isopropenyl ketone (trade name: "ODUR-1010", manufactured by Tokyo Ohka Kogyo Co., Ltd.), which was a positive photosensitive resin becoming a mold of an ink flow passage 13, was applied on a substrate 1 provided with energy-generating elements 2 by spin coating, followed by heat treatment at 120° C. for 6 minutes to form a positive photosensitive resin layer having a thickness of 14 μm. Subsequently, the pattern of the ink flow passage was exposed with exposure equipment UX3000 (trade name, manufactured by Ushio Inc.). The exposed portion of the positive photosensitive resin layer was developed using methyl isobutyl ketone (MIBK) and was then rinsed with isopropyl alcohol (IPA) to form a mold material 3 (FIG. 2A).

Subsequently, in order to form an ejection port-forming member 4, a photocationic polymerizable resin having a composition shown in Table 1 was applied by spin coating, and heat treatment at 60° C. for 9 minutes was then performed to form a photocationic polymerizable resin layer 4P on the mold material 3 and the substrate 1 such that the thickness from the upper surface of the mold material 3 was 25 μm (FIG. 2B).

TABLE 1

| | | |
|---|---|---|
| Epoxy resin | EHPE-3150, Daicel | 100 parts by mass |
| Additive | 1,4-HFAB, Central Glass | 20 parts by mass |
| Photocationic polymerization initiator | SP-172, ADEKA | 6 parts by mass |
| Silane coupling agent | A-187, GE Toshiba Silicones | 5 parts by mass |
| Solvent | Xylene, Kishida Chemical | 70 parts by mass |

Subsequently, a condensate composed of a compound represented by Formula (5A) shown below, glycidyl propyl triethoxysilane, and methyl triethoxysilane was selected as a fluorine-containing compound for forming a liquid-repellent layer 5. This condensate was diluted with a solvent mixture of 2-butanol and ethanol to prepare a liquid-repellent material. This liquid-repellent material was applied to the uncured photocationic polymerizable resin layer 4P by slit coating, followed by heat treatment at 70° C. for 3 minutes to volatilize the solvent mixture. Thus, a liquid-repellent material layer 5P was formed such that the thickness from the upper surface of the photocationic polymerizable resin layer 4P was 0.5 μm (FIG. 2C).

Formula (5A)

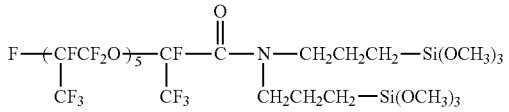

Subsequently, a first exposure step was performed. The liquid-repellent material layer 5P was exposed to 4000 J/m$^2$ using an i-ray exposure stepper (manufactured by CANON KABUSHIKI kAISHA) through a first mask 6 such that the portion except the region corresponding to the ejection ports 12 becomes the exposure region (4*a* and 5*a*) (FIG. 2D).

Subsequently, a second exposure step was performed. The region for forming a liquid-nonrepellent region 11, except the regions corresponding to the ejection ports 12, was exposed to 150 J/m$^2$ at a wavelength of 270 nm or less with MA200 compact (trade name, manufactured by SUSS MicroTec AG) through a second mask 8 (FIG. 2E).

Figure 6:
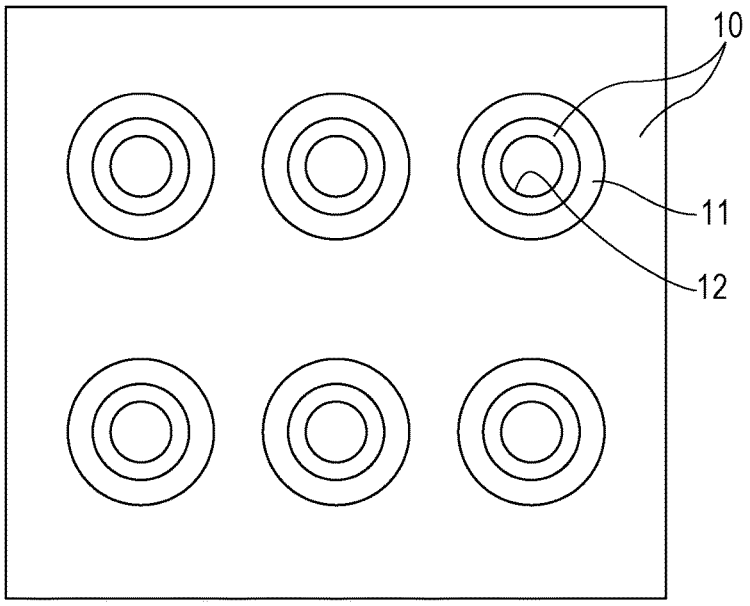
FIG. 6 is a schematic diagram illustrating an example of the ejection port surface of the inkjet recording head of the present invention.

Subsequently, heat treatment was performed at 95° C. for 4 minutes. Except the regions corresponding to the ejection ports 12, the exposure region 4*a* of the photocationic polymerizable resin layer 4P and the exposure region 5*a* of the liquid-repellent material layer 5P were cured to form the ejection port-forming member 4 and the liquid-repellent layer 5 (liquid-repellent region 10 and liquid-nonrepellent region 11) (FIG. 2F). The unexposed region was then developed with a solution mixture of xylene and methyl isobutyl ketone (MIBK) (mass ratio: 6/4) and was rinsed with xylene to form ejection ports 12 (FIG. 2G). FIG. 6 is a schematic diagram of the ejection port surface of an inkjet recording head including the ejection ports 12, liquid-repellent regions 10, and liquid-nonrepellent regions 11.

Subsequently, a supply passage 14 was formed by anisotropic etching of the substrate 1 using an alkaline solution, tetramethyl ammonium hydroxide (TMAH). The substrate 1 was then immersed in methyl lactate for removing the mold material 3 by dissolution to form a flow passage 13 (FIG. 2H). Then, electrical bonding for driving the energy-generating element 2 was performed. Furthermore, ink-supplying member for supplying an ink and other components were connected to manufacture an inkjet recording head. This inkjet recording head was evaluated by the evaluation method described below. The dynamic receding contact angles θr with pure water of the liquid-repellent region and the liquid-nonrepellent region of the produced inkjet recording head measured with DropMeasure (trade name, manufactured by Microjet Corporation) were 97 degrees and 56 degrees, respectively.

Example 2

Figure 7:
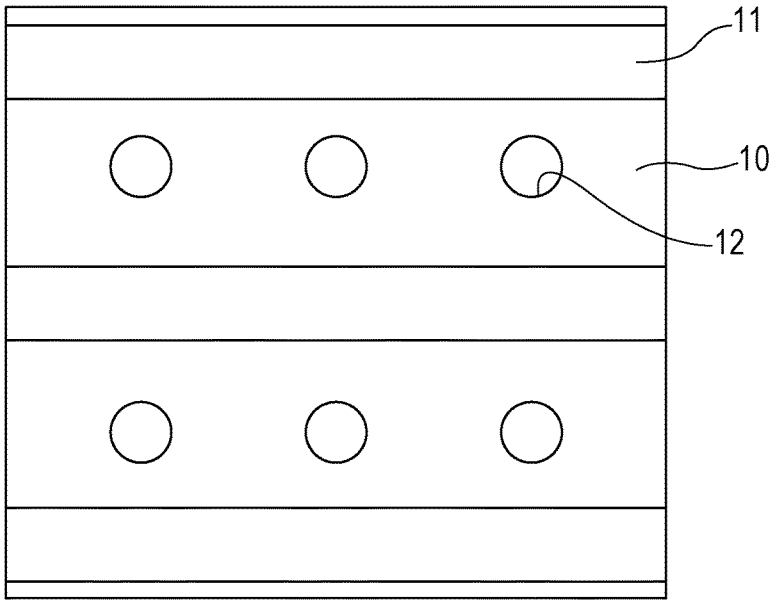
FIG. 7 is a schematic diagram illustrating another example of the ejection port surface of the inkjet recording head of the present invention.

An inkjet recording head was manufactured as in Example 1 except that in the ejection port surface of the inkjet recording head, the liquid-repellent region 10 and the liquid-nonrepellent region 11 were formed as shown in the schematic diagram of FIG. 7 with respect to the ejection ports 12, and was evaluated. The dynamic receding contact angles θr with pure water of the liquid-repellent region and the liquid-nonrepellent region of the manufactured inkjet recording head were 97 degrees and 54 degrees, respectively.

Example 3

An inkjet recording head was manufactured as in Example 1 except that the fluorine-containing compound used was a copolymer containing monomer units represented by Formula (9) at a molar ratio of 25:25:50, and was evaluated. The dynamic receding contact angles θr with pure water of the liquid-repellent region and the liquid-nonrepellent region of the manufactured inkjet recording head were 95 degrees and 55 degrees, respectively.

Formula (9)

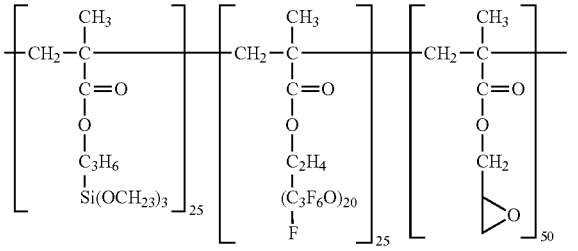

Example 4

An inkjet recording head was manufactured as in Example 1 except that as shown in FIGS. 3E to 3H, a second exposure step using a second mask 8 was performed after formation of the ejection ports 12 (FIG. 3G), and was evaluated. The dynamic receding contact angles θr with pure water of the liquid-repellent region and the liquid-nonrepellent region of the manufactured inkjet recording head were 97 degrees and 60 degrees, respectively.

Example 5

As shown in FIGS. 4A to 4E, ejection ports 12 were formed in the ejection port-forming member 4. Subsequently, a liquid-repellent material layer 5P was formed by slit coating (FIG. 4F), and the entire surface thereof was irradiated with first exposure light 7 to form a liquid-repellent layer 5 (FIG. 4G). A second exposure step was performed by irradiating second exposure light 9 using a third mask 15 (FIG. 4H). A supply passage 14 and a flow passage 13 were formed as in Example 1 to manufacture an inkjet recording head (FIG. 4I), and the inkjet recording head was evaluated. The dynamic receding contact angles θr with pure water of the liquid-repellent region 10 and the liquid-nonrepellent region 11 of the liquid-repellent layer 5 of the manufactured inkjet recording head were 95 degrees and 60 degrees, respectively.

Comparative Example 1

For comparison, an inkjet recording head having a liquid-nonrepellent region 58 formed by partially removing the liquid-repellent layer 55, as shown in FIGS. 5A to 5D, was manufactured. The inkjet recording head having a liquid-nonrepellent region 58 will now be described with reference to FIGS. 5A to 5D. The substrate 51, the energy-generating element 52, the mold material 53, the photocationic polymerizable resin layer 54P, and the liquid-repellent material layer 55P were the same as those in Example 1.

Figure 5A:
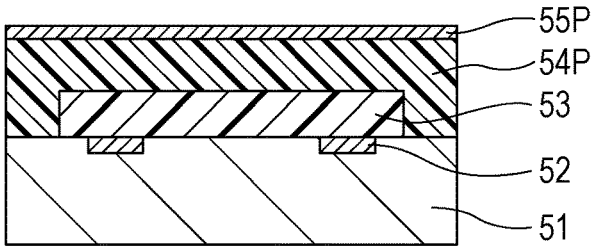
FIGS. 5A to 5D are process diagrams explaining another example of the method of manufacturing an inkjet recording head of the present invention.
Figure 5B:
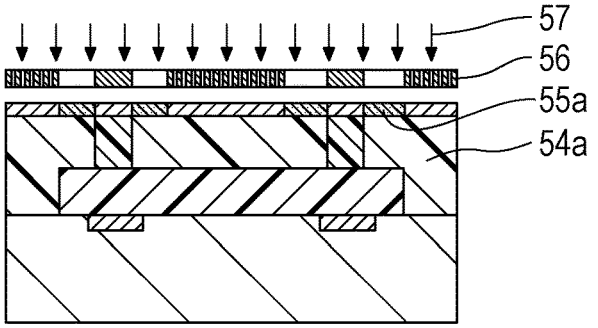
Figure 5C:
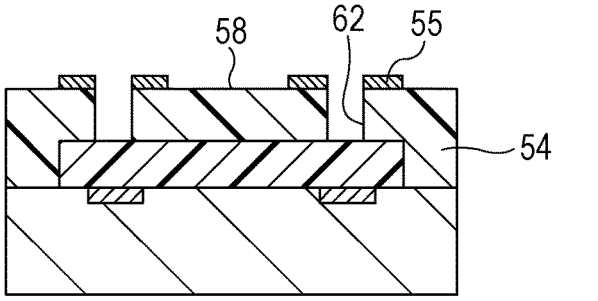
Figure 5D:
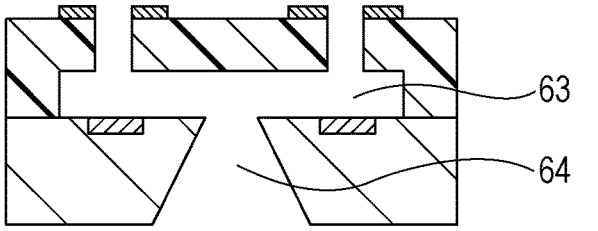

As in Example 1, polymethyl isopropenyl ketone was applied onto the substrate 51 provided with an energy-generating element 52 to form a mold material 53 becoming the pattern of an ink flow passage by patterning. A photocationic polymerizable resin layer 54P and a liquid-repellent material layer 55P were further formed thereon (FIG. 5A). Subsequently, the photocationic polymerizable resin layer 54P and a liquid-repellent material layer 55P were irradiated with i-rays 57 at 4000 J/m$^2$ using an i-ray exposure stepper (manufactured by CANON KABUSHIKI kAISHA) through a mask 56 having a pattern of ejection ports 62 and a liquid-nonrepellent region 58 (FIG. 5B). On this occasion, the mask 56 used had a mask pattern of less than the limiting resolution of the photocationic polymerizable resin layer 54P in the region corresponding to the liquid-nonrepellent region 58. Due to the mask 56, the photocationic polymerizable resin layer 54P of the liquid-nonrepellent region becomes an exposure region 54*a*, and the liquid-repellent material layer 55P is unexposed in the liquid-nonrepellent region and becomes an exposure region 55*a* only in the periphery of each ejection port. The mask pattern of less than the limiting resolution of the photocationic polymerizable resin layer 54P refers to a pattern size that does not expose the photocationic polymerizable resin layer until the depth of the substrate, but exposes until a certain depth in some cases. Subsequently, as in Example 1, heat treatment and development were performed to cure the exposure regions 54*a* and 55*a* into an ejection port-forming member 54 and a liquid-repellent layer 55, respectively. The unexposed liquid-repellent material layer 55P and photocationic polymerizable resin layer 54P were removed by development to form ejection ports 62 (FIG. 5C). Subsequently, as in Example 1, a supply passage 64 was formed, and the mold material 53 forming an ink flow passage pattern was removed by dissolution to form a flow passage 63 (FIG. 5D). Thus, an inkjet recording head was manufactured and then evaluated. The dynamic receding contact angles θr with pure water of the liquid-repellent region (liquid-repellent layer 55) and the liquid-nonrepellent region 58 (ejection port-forming member surface) of the manufactured inkjet recording head were 97 degrees and 55 degrees, respectively.

Evaluation

Each of the manufactured inkjet recording heads was filled with a black ink and was subjected to a continuous printing test after blade wiping. After conducting blade wiping the number of times shown in Table 2, solid printing on 11 sheets of A4 size recording paper was continuously performed by ejecting the ink from all the ejection ports. Whether non-ejection by drawing of an ink droplet generated from ink mist into the nozzle occurred or not was observed. Observation of non-ejection was performed by visually checking unprinted stripes (non-ejection) in the solid printing. The criteria of the evaluation are as follows:

Excellent: No or only one unprinted stripe is observed;

Good: Two to four unprinted stripes are observed;

Poor: Five or more unprinted stripes are observed.

The evaluation results are shown in Table 2.

TABLE 2

| | Liquid-nonrepellent region | End of liquid-repellent region (difference in level) | Results of continuous printing test after blade wiping | | | | |
|---|---|---|---|---|---|---|---|
| | | | 1000 times | 5000 times | 10000 times | 30000 times | 50000 times |
| Example 1 | Exist | Not exist | Excellent | Excellent | Excellent | Excellent | Excellent |
| Example 2 | Exist | Not exist | Excellent | Excellent | Excellent | Excellent | Excellent |
| Example 3 | Exist | Not exist | Excellent | Excellent | Excellent | Excellent | Excellent |
| Example 4 | Exist | Not exist | Excellent | Excellent | Excellent | Excellent | Excellent |
| Example 5 | Exist | Not exist | Excellent | Excellent | Excellent | Excellent | Excellent |
| Comparative Example 1 | Exist | Exist | Excellent | Good | Poor | Poor | Poor |

The results shown above clearly demonstrate that the liquid-repellent region does not have an end (difference in level) by forming a liquid-repellent region 10 and a liquid-nonrepellent region 11 in the same surface of the liquid-repellent layer 5 according to the present invention. As a result, the liquid-repellent layer 5 is not peeled off even if blade wiping is performed, and printing quality can be maintained. More specifically, even if continuous recording is performed for a long time with a high frequency drive at a high printing speed and a high duty, the liquid-nonrepellent region 11 of the liquid-repellent layer 5 can retain generated ink mist. Peeling off of the liquid-repellent layer due to blade wiping also hardly occurs, and drawing of ink droplets into the ejection ports can be prevented. In the evaluation described above, black ink was used. Similar results can be obtained even in simultaneous driving of a plurality of color inks. The liquid-nonrepellent region 11 can be formed by photolithography with a high positional accuracy, and can be applied to various forms of use by appropriately selecting the mask.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-167744, filed Aug. 20, 2014, which is hereby incorporated by reference herein in its entirety.

What is claimed is:

1. A method of manufacturing an inkjet recording head comprising a substrate including an energy-generating element generating energy for ejecting a liquid, an ejection port for ejecting the liquid, an outermost liquid-repellant layer on the ejection port-forming surface of a member forming the ejection port, and a liquid flow passage communicating with the ejection port, the method comprising:

forming a liquid-repellent material layer serving as the outermost liquid-repellant layer on a surface of a layer serving as the member;

partially reducing a liquid repellency of the liquid-repellent material layer to form a liquid-repellent region having a contact angle of 80 degrees or more with pure water and a liquid-nonrepellent region having a contact angle with pure water that is less than the contact angle of the liquid-repellent region by 30 degrees or more, on the same surface of the outermost liquid-repellent layer, wherein the liquid-repellent material layer contains a fluorine-containing compound including a carbonyl group having a bond with a fluorine-containing group as a liquid-repellent component.

2. The method of manufacturing an inkjet recording head according to claim 1, wherein the liquid repellency is partially reduced by irradiating the liquid-repellent material layer with light containing a wavelength decomposing a liquid-repellent component in the liquid-repellent material layer.

3. The method of manufacturing an inkjet recording head according to claim 2, wherein the wavelength decomposing the liquid-repellent component in the liquid-repellent material layer is 300 nm or less.

4. The method of manufacturing an inkjet recording head according to claim 1, wherein the fluorine-containing compound includes a perfluoro alkyl group or a perfluoro polyether group.

5. The method of manufacturing an inkjet recording head according to claim 1, wherein the fluorine-containing compound is composed of a polymer including a monomer unit including a carbonyl group having a bond with a fluorine-containing group represented by Formula (6):

Formula (6)

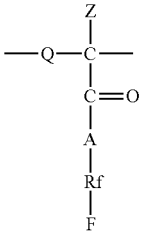

where Rf represents a perfluoro alkyl group or a perfluoro polyether group; A represents a direct bond, a linear, branched, or cyclic aliphatic group having 1 to 12 carbon atoms and optionally containing an oxygen and/or nitrogen atom, an aromatic group having 6 to 10 carbon atoms and optionally containing an oxygen atom, a urethane group, or a —$CH_2CH(OT)CH_2$— group (where T is a hydrogen atom or an acetyl group); Q represents an organic group having 1 to 12 carbon atoms; and Z represents a hydrogen atom or a methyl group.

6. The method of manufacturing an inkjet recording head according to claim 5, wherein the polymer is a copolymer including, in addition to a monomer unit represented by Formula (6), monomer units represented Formula (7) and Formula (8):

Formula (7)

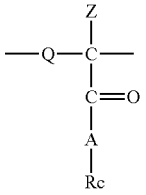

where Rc represents a cationic polymerizable group; A represents a direct bond, a linear, branched, or cyclic aliphatic group having 1 to 12 carbon atoms and optionally containing an oxygen and/or nitrogen atom, an aromatic group having 6 to 10 carbon atoms and optionally containing an oxygen atom, a urethane group, or a —$CH_2CH(OT)CH_2$— group (where T is a hydrogen atom or an acetyl group); Q represents an organic group having 1 to 12 carbon atoms; and Z represents a hydrogen atom or a methyl group;

Formula (8)

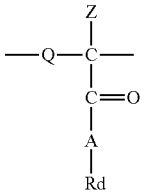

where Rd represents an alkyl group, an aryl group, or a reactive silane group; A represents a direct bond, a linear, branched, or cyclic aliphatic group having 1 to 12 carbon atoms and optionally containing an oxygen and/or nitrogen atom, an aromatic group having 6 to 10 carbon atoms and optionally containing an oxygen atom, a urethane group, or a —$CH_2CH(OT)CH_2$— group (where T is a hydrogen atom or an acetyl group); Q represents an organic group having 1 to 12 carbon atoms; and Z represents a hydrogen atom or a methyl group.

7. The method of manufacturing an inkjet recording head according to claim 1, wherein the fluorine-containing compound has a reactive silane group.

8. The method of manufacturing an inkjet recording head according to claim 7, wherein the fluorine-containing compound includes the compound represented by Formula (4):

Formula (4)

$$F—Rf—D—[Q—SiR_aY_{3-a}]_n$$

where Rf represents a perfluoro alkyl group or a perfluoro polyether group; R represents a hydrolyzable substituent group; Y represents a nonhydrolyzable substituent group; D represents an aliphatic group having 1 to 12 carbon atoms and containing an oxygen, including a carbonyl group, and a nitrogen atom; Q represents an organic group having 1 to 12 carbon atoms; n is an integer of 1 or more; and a is an integer of 1 to 3.

9. The method of manufacturing an inkjet recording head according to claim 1, wherein the liquid-repellent region is formed in the periphery of the ejection port.

10. The method of manufacturing an inkjet recording head according to claim 1, wherein the member forming the ejection port is formed into the ejection port by forming a photocationic polymerizable resin layer containing a photocationic polymerization initiator and a cationic polymerizable resin on the substrate, and then subjecting a region except the region for forming the ejection port to exposure curing and development.

11. The method of manufacturing an inkjet recording head according to claim 10, comprising:

forming a liquid-repellent material layer containing the liquid-repellent component on the photocationic polymerizable resin layer formed on the substrate;

irradiating a region except the region for forming the ejection port with first exposure light not containing a wavelength decomposing the liquid-repellent component; and irradiating the liquid-nonrepellent region with second exposure light containing a wavelength decomposing the liquid-repellent component.

12. The method of manufacturing an inkjet recording head according to claim 1, wherein the liquid-repellent region is formed to surround one ejection port along the outer shape of the ejection port and the liquid-nonrepellent region is formed to surround the liquid-repellent region surrounding the ejection port along the outer shape of the liquid-repellent region.

* * * * *